US006709091B1

(12) United States Patent
Takahashi

(10) Patent No.: US 6,709,091 B1
(45) Date of Patent: Mar. 23, 2004

(54) INK EJECTION DEVICE AND DRIVING METHOD THEREFOR

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/069,777

(22) Filed: Apr. 30, 1998

Related U.S. Application Data

(63) Continuation-in-part of application No. 08/705,153, filed on Aug. 29, 1996, now Pat. No. 5,805,177.

(30) Foreign Application Priority Data

Apr. 30, 1997 (JP) ..... P9-112744
Apr. 30, 1997 (JP) ..... P9-112745

(51) Int. Cl.[7] ..... B41J 2/045
(52) U.S. Cl. ..... 347/71
(58) Field of Search ..... 347/10, 11, 19, 347/68–72; 400/120.01, 124.02, 118.2

(56) References Cited

U.S. PATENT DOCUMENTS

| | | | | |
|---|---|---|---|---|
| 4,879,568 A | | 11/1989 | Bartky et al. | |
| 4,887,100 A | | 12/1989 | Michaelis et al. | |
| 4,992,808 A | | 2/1991 | Bartky et al. | |
| 5,003,679 A | | 4/1991 | Bartky et al. | |
| 5,028,936 A | | 7/1991 | Bartky et al. | |
| 5,764,247 A | * | 6/1998 | Asai | 347/69 X |
| 5,805,177 A | * | 9/1998 | Takahashi | 347/11 |
| 5,880,750 A | * | 3/1999 | Takahashi | 347/11 X |
| 5,909,228 A | * | 6/1999 | Takahashi | 347/10 |
| 5,940,098 A | * | 8/1999 | Minemoto et al. | 347/11 X |
| 6,086,189 A | | 7/2000 | Hosono et al. | |
| 6,151,050 A | | 11/2000 | Hosono et al. | |

FOREIGN PATENT DOCUMENTS

| | | |
|---|---|---|
| JP | 9112744 | 4/1915 |
| JP | 9112745 | 4/1915 |
| JP | 63094854 | 4/1988 |
| JP | 63-247051 | 10/1988 |
| JP | 1113252 | 5/1989 |
| JP | 4189144 | 7/1992 |
| JP | 4339660 | 11/1992 |
| JP | 8336970 | 12/1996 |
| JP | 9-57690 | 3/1997 |
| JP | 957960 | 3/1997 |

* cited by examiner

*Primary Examiner*—Edward Lefkowitz
*Assistant Examiner*—Charlene Dickens
(74) *Attorney, Agent, or Firm*—Connolly Bove Lodge & Hutz LLP

(57) ABSTRACT

An ink ejection device capable of canceling pressure wave vibrations remaining in ink after the ink has been ejected, regardless of the temperature of the ink. In response to a one-dot print command, the volume of the corresponding ink channel is increased (AS) then decreased (AE) after an interval 1.0 T (T is the time required for a pressure wave to propagate once across the length of the ink channel), causing ink to eject. After an interval of 0.75 T, the volume of the ink channel is again increased (BS) and then decreased (BE) after an interval 1.0 T, causing ink to eject again. After a pulse interval d2, determined according to the temperature of the ink, a non-ejection pulse signal C having a pulse width of 0.5 T is generated to cancel the pressure wave vibrations in the ink. For example, d2 is set to 2.45 T when ink temperature is between 0 and 10° C. Preferably, the non-ejection pulse signal C is generated such that the center HC of the signal C is set to the third time that the pressure wave vibration crosses the center of the vibration or the neutral level of the pressure after completion of the ejection operation. Generating the non-ejection pulse signal C at this timing enables the ink ejection device to reliably cancel pressure wave vibrations in the ink channel.

64 Claims, 6 Drawing Sheets

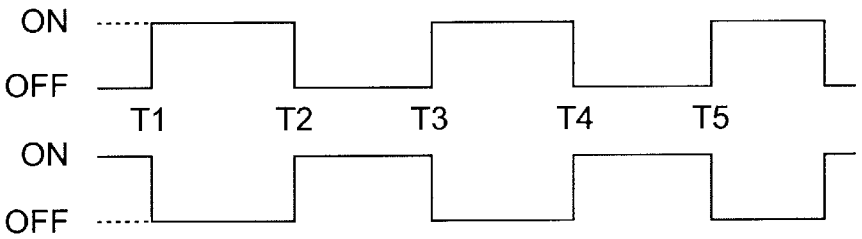
FIG. 4 (a)
FIG. 4 (b)
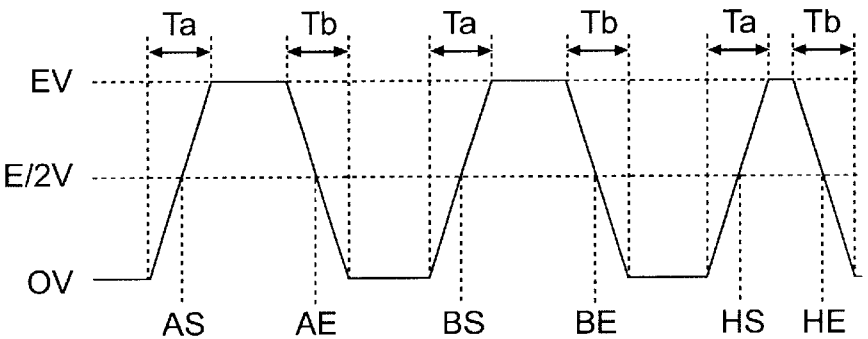
FIG. 4 (c)
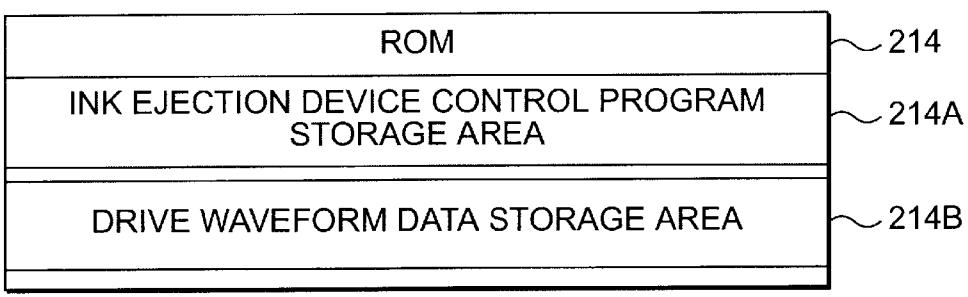
FIG. 5

AS
AE
BS
BE
A
B d2
P

INK EJECTION DEVICE AND DRIVING METHOD THEREFOR

BACKGROUND OF THE INVENTION

This application is a continuation-in-part of U.S. patent application Ser. No. 08/705,153 filed Aug. 29, 1996 and issued Sep. 8, 1998 now U.S. Pat. No. 5,805,177 entitled "Shear Mode Driving Method for an Ink Ejection Device That Accommodates Temperature Change" and assigned to the same assignee of the present application.

BACKGROUND OF THE INVENTION

1. Field of the Invention

The present invention relates to an ink ejection device for forming images on a recording medium by ejecting ink droplets from nozzles according to printing commands. The invention also relates to a driving method for the ink ejection device that forms.

2. Description of the Related Art

Non-impact type printing devices have recently taken the place of conventional impact type printing devices and are holding an ever-growing share of the market. Of these non-impact type printing devices, ink-ejecting type printing devices have the simplest operation principle, but are still capable of effectively and easily performing multi-gradation and color printing. Of these devices, a drop-on-demand type for ejecting only ink droplets which are used for printing has rapidly gained popularity because of its excellent ejection efficiency and low running cost.

A shear mode type printer using a piezoelectric actuator is one of the drop-on-demand types. Such a printer is disclosed in U.S. Pat. No. 4,879,568. One example of such type of printer is shown in FIGS. 1(*a*) and 1(*b*) in which FIG. 1(*a*) is a cross-sectional view taken along line A—A in FIG. 1(*b*) an FIG. 1(*b*) is also a cross-sectional view taken along line B—B in FIG. 1(*a*).

As shown in FIGS. 1(*a*) and 1(*b*), the shear mode type ink ejection device 600 includes a bottom wall 601, a ceiling wall 602, and elongated shear mode actuator walls 603 sandwiched therebetween. Each actuator wall 603 includes a lower wall 607 adhesively attached to the bottom wall 601 and an upper wall 605 adhesively attached to the ceiling wall 602. The upper and lower walls 605, 607 are polarized in the directions indicated by arrows 609, 611, respectively. Alternating pairs of actuator walls 603 form in alternation ink channels 613 therebetween or spaces 615, which are narrower than the ink channels 613.

Electrodes 619 and 621 are provided on both side surfaces of each actuator wall 603. Specifically, the electrode 619 is provided in the ink channel 613 and the electrode 621 is provided in the space 615. The electrode 621 is also provided on the outer side surface of each of the two outermost actuator walls 603. The electrode 619 is covered by an insulating layer (not shown) to insulate it from the ink. The electrodes 621 are connected to ground 623. The electrodes 619 are connected to a control unit 625 in a form of a silicon chip which applies voltages (driving signals) to the electrodes 619 as will be described later.

A nozzle plate 617 is fixedly secured to one end of the actuator walls 603. The nozzle plate 617 is formed with nozzles 618 at positions corresponding to the ink channels 613. An ink supplying source (not shown) is connected to the other end of the actuator walls 603 through a manifold 626. The manifold 626 includes a front wall 627 formed with openings in positions corresponding to the ink channels 613, and a rear wall 628 for sealing the space between the bottom wall 601 and the ceiling wall 602. Ink from the ink supplying source is supplied to the manifold 626 or common ink chamber and distributed into the respective ink channels 613. The front wall 627 prevents ink from the manifold 626 from entering the spaces 615.

To eject droplets, a voltage from the control unit 625 is applied to the electrode 619 of each ink channel 613. Pairs of the actuator walls 603 deform outward by the piezoelectric shear effect so that the volume of each ink channel 613 increases. In the example shown in FIG. 2, when a voltage E volts is applied to the electrode 619*c* of the ink channel 613*c*, an electric field is developed in the actuator wall 603*e* in the direction indicated by the arrow 631, and an electric field is developed in the actuator wall 603*f* in the direction indicated by the arrow 632. Because the electric field directions 631 and 632 are at right angles to the polarization direction 609, 611, the actuator walls 603*e*, 603*f* deform outward to increase the volume of the ink channel 613*c* by the piezoelectric shear effect, resulting in a decrease in the pressure in the ink chamber 613*c*, including near the nozzle 618*c*.

Application of the voltage E(V) is maintained for a duration of time T, during which time ink is supplied from the ink supplying source. A pressure wave occurring when the ink is supplied from the ink supplying source propagates in the lengthwise direction of the ink channel 613*c*. The duration of time T corresponds to a duration of time required for the pressure wave to propagate once in the lengthwise direction of the ink channel 613*c*. The duration of time T can be calculated by the following formula:

$$T=L/a$$

wherein L is the length of the ink channel 613; and a is the speed of sound through the ink filling channel 613*c*.

Theories on pressure wave propagation teach that at the moment the duration of time L/a elapses after the application of the voltage, the pressure in the ink channel 613*c* inverts to a positive pressure. The voltage application to the electrode 619*c* of the ink channel 613*c* is stopped in timed relation with this pressure inversion so that the actuator walls 603*e*, 603*f* revert to their initial shape shown in FIG. 1(*a*).

The pressure generated when the actuator walls 603*e*, 603*f* return to their initial shape is added to the inverted positive pressure so that a relatively high pressure is generated in the ink channel 613*c*. This relatively high pressure ejects an ink droplet 26 from the nozzle 618*c*.

The inventor of the present invention developed a method for executing a remaining pressure wave canceling operation. In the canceling operation, pressure wave vibrations are generated in the ink of the ink channel 613 after execution of the ejection operation. The canceling operation is executed by applying the voltage E volts to the electrode 619*c* at a specified time, and subsequently returned to 0 volts in order to increase and then decrease the volume of the ink channel 613. With this canceling operation, not only do the pressure wave vibrations converge at an early stage, thereby preventing unintentional ejection of ink due to residual pressure wave, but also the transition to process the next print command can be performed quicker. As a result, the printing device can form a more faithful image and printing speed can be improved.

However, the speed of sound a described above changes according to the temperature of the ink, as does the actual value of the time T required for a pressure wave to propagate once across the length of the ink channel 613. Therefore, if the canceling operation is executed at a fixed timing regardless of the temperature of the ink, it is possible that the pressure wave vibrations will not be satisfactorily offset. In some cases, an ejection operation corresponding to the next print command may be executed before the pressure wave vibrations have converged, and the ejected ink may spray and scatter or the ink might not even be ejected.

Another problem exits in the remaining pressure wave canceling operation such that reliable cancellation of the pressure wave vibrations in the ink channels cannot be achieved. Because timing for executing the canceling operation has been set to an appropriate value through trial and error. In some cases, the ejection operation for the next print command is executed before the pressure wave vibrations have converged. As a result, the ejected ink can spray and scatter, or sometimes the ink does not eject at all. The canceling operation cannot always reliably cancel the pressure wave vibrations, particularly when driving the ink ejection device 600 at a rapid speed to support rapid printing, in which case the temperature of the ink rises, lowering the viscosity.

SUMMARY OF THE INVENTION

In view of the foregoing, it is an object of the present invention to provide an ink ejection device capable of executing a canceling operation to cancel pressure wave vibrations in the ink, regardless of the temperature of the ink.

It is another object of the present invention to provide an ink ejection device capable of forming faithful images by canceling pressure wave vibrations that exist within the ink chamber and capable of increasing the printing speed.

These and other objects of the present invention will be attained by an ink ejection device including nozzles from which ink is ejected; ink channels provided on the back of the nozzles for being filled with ink; an actuator for applying pressure wave vibrations to ink in the ink channels; and a control unit for executing an ejection operation by driving the actuator in response to printing commands to apply pressure wave vibrations to the ink in the ink channels and cause ink to eject from the nozzles, and for subsequently executing a canceling operation by driving the actuator at timings based on the ink temperature in the ink channels to order to eliminate as much as possible the pressure wave vibrations in the ink.

With an invention of this construction, the control unit drives the actuator according to print commands in order to execute the ejection operation in the following way. First, the actuator generates pressure wave vibrations in the ink of the ink channel, which pressure wave vibrations cause ink to be ejected from the nozzle. After the ejection operation, the control unit drives the actuator to execute a canceling operation for sufficiently canceling the pressure wave vibrations in the ink. Accordingly, the pressure wave vibrations are made to converge at an early period to prevent ink from being ejected in a undesirable location as a result of residual pressure wave vibrations, and also to quickly proceed to process the next print command. Moreover, the control unit executes the canceling operation at a timing corresponding to the temperature of the ink in the ink channel. For this reason, the canceling operation can be satisfactorily executed regardless of the temperature of the ink. Therefore, the ink ejection device of the present invention can create an extremely accurate image by preventing ink from spraying and scattering and from not ejecting properly. Further, since the pressure wave vibrations in the ink are converged at an early period, the printing speed can be increased.

The cancellation described above does not need to completely eliminate the pressure wave vibrations. For example, the canceling operation can be configured to only restrain the pressure wave vibrations to a sufficient degree that ink is not ejected from the nozzle.

According to another aspect of the present invention, the actuator varies the volume of the ink channel; and after executing the ejection operation, the control unit drives the actuator to increase and decrease the volumes of the ink channel at timings based on the ink temperature in the ink channel in order to eliminate as much as possible the pressure wave vibrations in the ink.

In the present invention, the actuator described above varies the volumes of the ink channel. Through these volume variations, pressure wave vibrations are generated in the ink, causing ink to be ejected from the corresponding nozzle. The actuator executes the canceling operation by increasing and decreasing the volume of the ink channel. Accordingly, the canceling operation can be extremely proficient in canceling pressure wave vibrations in the ink. Therefore, the ink ejection device of the present invention can even more satisfactorily cancel the pressure wave vibrations in the ink to form an even more accurate image. As a result, the printing speed can be improved even further.

According to still another aspect of the present invention, the control unit drives the actuator to first increase the volume of the specified ink channel and to then decrease the volume of the same to eject ink from the corresponding nozzle, and, following a time interval determined according to both the time required for the ink pressure wave vibrations to propagate one way through the ink channel and the temperature of the ink, subsequently executes a canceling operation by again driving the actuator to first increase and then decrease the volume of the ink channel.

In executing an ejection operation in the present invention, the control unit drives the actuator to first increase the volume of the ink chamber. At this time, the pressure inside the ink chamber decreases, allowing ink to flow into the chamber. Next, the control unit drives the actuator to decrease the volume of the ink chamber. Hence, the pressure inside the ink chamber becomes relatively high, causing ink to be ejected from the corresponding nozzle. After a specified time determined by both the time T required for pressure wave vibrations in the ink to propagate once across the length of the ink channel and the temperature of the ink, the control unit executes a canceling operation by again increasing the volume of the ink channel and then decreasing that volume. Accordingly, the canceling operation can be executed at an appropriate timing based on this time T and the temperature of the ink, and the pressure wave vibration in the ink can be offset very well.

Therefore, the ink ejection device of the present invention is even more proficient in canceling the pressure wave vibrations in the ink and forms an even more accurate image. Further, the printing speed can be increased even more. Since the temperature of the ink is referenced in the present invention, the time T required for pressure wave vibrations in the ink to propagate once across the length of the ink channel can be fixed according to specified temperature ranges, thereby greatly simplifying the process.

According to yet another aspect of the present invention, the control unit executes an ejection operation in response to a one-dot print command and executes a canceling operation after a time interval d2, wherein d2 equals:

2.45 T, when the ink temperature in the ink chamber is between 0 and 10° C.;

2.50 T, when the ink temperature in the ink chamber is between 10 and 20° C.;

2.55 T, when the ink temperature in the ink chamber is between 20 and 30° C.; and 2.60 T, when the ink temperature in the ink chamber is between 30 and 40° C.; such that T is the time required for the ink pressure wave vibrations to propagate one way through the ink channel at room temperature. The control unit performs these operations by driving the actuator to first increase the volume of the specified ink channel and, following an interval of about 1.0 T or an odd multiple thereof, to then decrease the volume of the same to eject ink from the corresponding nozzle. After a time interval of about 0.75 T, the control unit subsequently executes a canceling operation by again driving the actuator to first increase the volume of the ink channel and, following a time interval of about 1.0 T or an odd multiple thereof, to decrease the volume of the ink channel to again eject ink from the corresponding nozzle.

According to this configuration, the volume of the ink channel is first increased and subsequently decreased after approximately 1.0 T or an odd multiple thereof, thereby ejecting ink from the nozzle. After an interval of about 0.75 T, the volume of the ink channel is again increased and subsequently decreased after an interval of approximately 1.0 T or an odd multiple thereof, again causing ink to eject from the nozzle.

Ink ejection is very efficient when the volume of the ink channel is decreased approximately 1.0 T or an odd multiple thereof after the volume of the ink channel has been increased. Since the period of the pressure wave vibrations in the ink of the ink chamber is about 2 T, the timing in which the internal pressure of the ink channel increases after increasing the volume of the ink channel and the timing in which the internal pressure of the ink channel increases due to decreasing the volume of the ink channel coincide, thereby creating a great pressure within the ink channel. Since the control unit executes the ejection operation twice over an interval of about 0.75 T, two droplets of ink are ejected very efficiently for each one-dot print command, thereby forming a rich image.

After completing the ejection operation, the control unit executes a canceling operation after the pulse interval d2, determined according to the temperature of the ink in the ink channel, has elapsed. By executing a canceling operation a pulse interval d2 after the above ejection operation has been completed, pressure wave vibrations in the ink can be very efficiently offset.

Therefore, the ink ejection device of the present invention is even more proficient in canceling the pressure wave vibrations in the ink and forms an even more accurate and richer image. Further, the printing speed can be increased even more.

According to another aspect of the present invention, the control unit increases or decreases the volume of the ink channel by applying a voltage to the actuator, and, moreover, applies the same voltage to the actuator both during an ejection operation and during a canceling operation.

Since the same voltage is applied to the actuator during both the ejection operation and the canceling operation in order to increase or decrease the volume of the ink channel, only one power source is necessary for supplying the drive signal, and, therefore, the construction of the control unit can be simplified. Further, the process for controlling the actuator is simplified by switching the applied voltage off and on. Hence, the construction and control of the ink ejection device can be even more simplified.

According to further another aspect of the present invention, the side walls of the ink channels in the actuator are formed of piezoelectric materials.

Since piezoelectric materials are used to construct the side walls of the ink channels, the volume of the ink channels can be changed by applying voltage to the piezoelectric materials. This type of actuator has a simple construction, is extremely durable, and is inexpensive. Therefore, an invention having this construction can simplify the construction, increase the durability, and further decrease the cost of the device.

The present invention also provides an ink ejection device including nozzles from which an ink is ejected; ink channels provided on the back of the nozzles for being filled with the ink; an actuator for varying volumes of the ink channels; and a driving device for executing an ejection operation by driving the actuator to generate pressure wave vibrations in the ink channels and cause the ink to eject from the nozzles, and for subsequently executing a canceling operation by driving the actuator to first increase and then decrease the volumes of the ink channels in order to eliminate as much as possible the pressure wave vibrations in the ink. The volume increases and decreases of the canceling operation are executed when the pressure wave vibrations cross the center of their vibration or the neutral pressure level, an odd number of times, that is, when the pressure changes from positive to negative.

With the construction described above, the control unit drives the actuator to vary the volume of the ink channels provided on the back of the nozzles, generating pressure wave vibrations in the ink channels and ejecting ink from those channels.

Subsequently, the control unit executes a canceling operation to cancel the pressure wave vibrations in the ink channels. In this canceling operation, the control unit drives the actuator to first increase the volume of the ink channels and subsequently decrease that volume. As a result, the pressure wave vibrations in the ink channels are quickly converged, thereby preventing ink from being ejected in an undesirable location by remaining pressure wave vibrations and quickly proceeding to the ejection operation corresponding to the next print command. Moreover, the control unit increases and decreases the volumes of the ink channels during the canceling operation at points when the frequency wave crosses the center of the vibration an odd number of times, that is, when the pressure changes from positive to negative.

Here, the inventors of the invention studied the relationship between the waveform of the pressure wave vibrations in the ink channels and the time for executing a cancel operation capable of most effectively canceling those pressure wave vibrations. As a result, the inventors discovered that the cancel operation is most effectively executed after the ejection operation when the pressure wave vibrations cross the center of the vibrations an odd number of times, particularly, three times. In this case, the pressure waves in the ink channels are converged at an extremely early period, thereby effectively preventing ink from ejected at an undesirable location and allowing the ink ejection device to proceed very quickly to the ejection process in response to the next print command. Moreover, the canceling operation demonstrates an ability to stabilize the pressure wave vibrations, regardless of various conditions.

Since the waveform shape of the pressure wave vibrations when crossing the center of the vibration a third times is similar to the waveform shape when crossing the center of the vibration in the other odd number of times, it is possible to assume that the effects of executing the cancel operation at these times are approximately the same. In other words, the pressure within the ink channel immediately after completion of the ejection operation has risen near the peak of the pressure wave. Afterward, the pressure wave vibrates periodically and, when crossing the center of the vibration an odd number of times, the pressure wave crosses the center in a declining direction at approximately the same slope.

In the present invention, the canceling operation is executed after the ejection operation and when the pressure wave vibration crosses the center of the vibration an odd number of times. Accordingly, the pressure wave vibrations in the ink channels are converged at an extremely early time, thereby effectively preventing ink from being ejected at an undesirable location and allowing the ink ejection device to proceed quickly to the ejection process corresponding to the next print command. Moreover, the effects of this invention demonstrate reliability. Therefore, the ink ejection device of the present invention forms an accurate image by reliably canceling pressure wave vibrations remaining in the ink channels and improving printing speed.

In the canceling operation described above it is not necessary to completely eliminate the pressure wave vibrations. For example, it is possible to restrain the pressure wave vibrations to the degree that ink is not ejected from the nozzles.

Preferably, the odd number of times is set to three. With this configuration, the invention can reliably cancel pressure wave vibrations. Moreover, it is possible to converge the pressure wave vibrations at an earlier time than when the above-described odd number of times is set to five, seven, or more. Accordingly, an even more accurate image is created by reliably canceling pressure wave vibrations at an even earlier time, thereby improving the print speed even further.

According to another aspect of the present invention, the control unit repeatedly executes the ejection operation a plurality of times in response to a one-dot print command and executes the canceling operation after all ejection operations are completed for the one-dot print command.

With the configuration described above, a plurality of ink droplets is ejected in response to a one-dot print command, thereby forming a richer image. By repeatedly executing the ejection process a plurality of times, the pressure wave vibrations in the ink channels become more complex, making it more difficult to set an appropriate timing for executing the cancel operation. In the present invention, this problem is overcome by executing the canceling operation at a time when the pressure wave vibrations have crossed the center of the vibration an odd number times, as described above. As a result, a timing for executing the cancel operation can be easily set. Moreover, it is possible to reliably cancel the pressure wave vibrations. Therefore, an even richer image can be formed, and costs for developing the ink ejection device can be further decreased by simplifying the settings for the device.

According to another aspect of the present invention, the time that elapses during the canceling operation after the volume of the ink channel is increased and until the volume is decreased is about 0.3 to 0.7 or about 1.3 to 1.7 times the length of time required for a pressure wave to propagate once across the length of the ink channel.

The inventor of the present invention conducted an experiment in which the time interval (hereinafter referred to as the "pulse width Wc") in the cancel operation after the volume of the ink channel is increased until the volume of the ink channel is decreased was changed to various lengths, and studied the values of the pulse width Wc capable of most effectively canceling pressure wave vibrations in the ink channel. As a result, the inventor discovered that the pulse width Wc should be set to 0.3 to 0.7 or 1.3 to 1.7 times the time required for a pressure wave in the ink to propagate one direction along the ink channel (hereinafter referred to as the "time T").

It is presumed that Wc is best set to these values for the following reason. When Wc=1.0 T, the peak of the pressure wave vibrations generated by increasing the volume of the ink channel and the increase in pressure generated by the decrease in the volume of the ink channel combine to eject ink from the nozzles. When Wc=2.0 T, the pressure wave vibrations caused by increasing the volume and the pressure wave vibrations generated by decreasing the volume cancel each other out, inviting the same effect as when not executing a canceling operation. Accordingly, by setting the pulse width Wc to a value between these values, such as 0.3 to 0.7 T or 1.3 to 1.7 T, it is thought that the canceling operation can be effectively executed.

Since in the present invention Wc is set at approximately 0.3 to 0.7 T or approximately 1.3 to 1.7 T, the canceling operation can be very effectively executed. Therefore, an even more accurate image can be formed by more effectively canceling the pressure wave vibrations, and the printing speed can be improved even further.

BRIEF DESCRIPTION OF THE DRAWINGS

The particular features and advantages of the invention as well as other objects will become apparent from the following description taken in connection with the accompanying drawings, in which:

FIG. 1(*b*) is a cross-sectional view taken along a line B—B in FIG. 1(*a*), showing the configuration of the conventional ink ejection device shown in FIG. 1(a);

FIG. 4(*a*) is a timing chart showing pulse waves issued by a charge circuit of the control unit;

FIG. 4(*b*) is a timing chart showing pulse waves issued by a discharge circuit of the control unit;

FIG. 4(*c*) is a timing chart showing the voltage applied to an actuator;

FIG. 5 is an explanatory diagram showing the construction of the ROM in the control unit;

FIG. 6(*b*) is an explanatory diagram showing the pressure wave vibration in the ink channel;

FIG. 7(*b*) is an explanatory diagram showing the pressure wave vibration caused when the ejection pulse signal A rises;

FIG. 7(*c*) is an explanatory diagram showing the pressure wave vibration caused when the ejection pulse signal A drops;

FIG. 7(*d*) is an explanatory diagram showing the pressure wave vibration caused when the ejection pulse signal B rises;

FIG. 7(*e*) is an explanatory diagram showing the pressure wave vibration caused when the ejection pulse signal B drops; and FIG. 7(*f*) is an explanatory diagram showing the pressure wave vibration combining the vibrations caused by the two ejection pulse signals A and B.

DETAILED DESCRIPTION OF THE PREFERRED EMBODIMENTS

Figure 1:
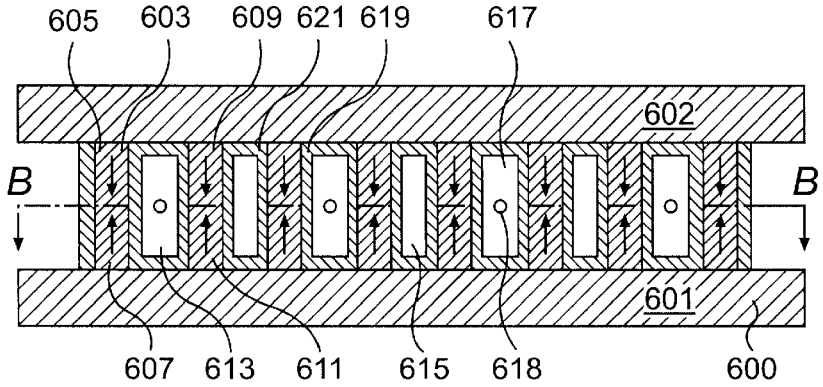
FIG. 1 (a) PRIOR ART
FIG. 1(*a*) is a cross-sectional view taken along a line A—A in FIG. 1(*b*), showing the configuration of a conventional ink ejection device.
Figure 1:
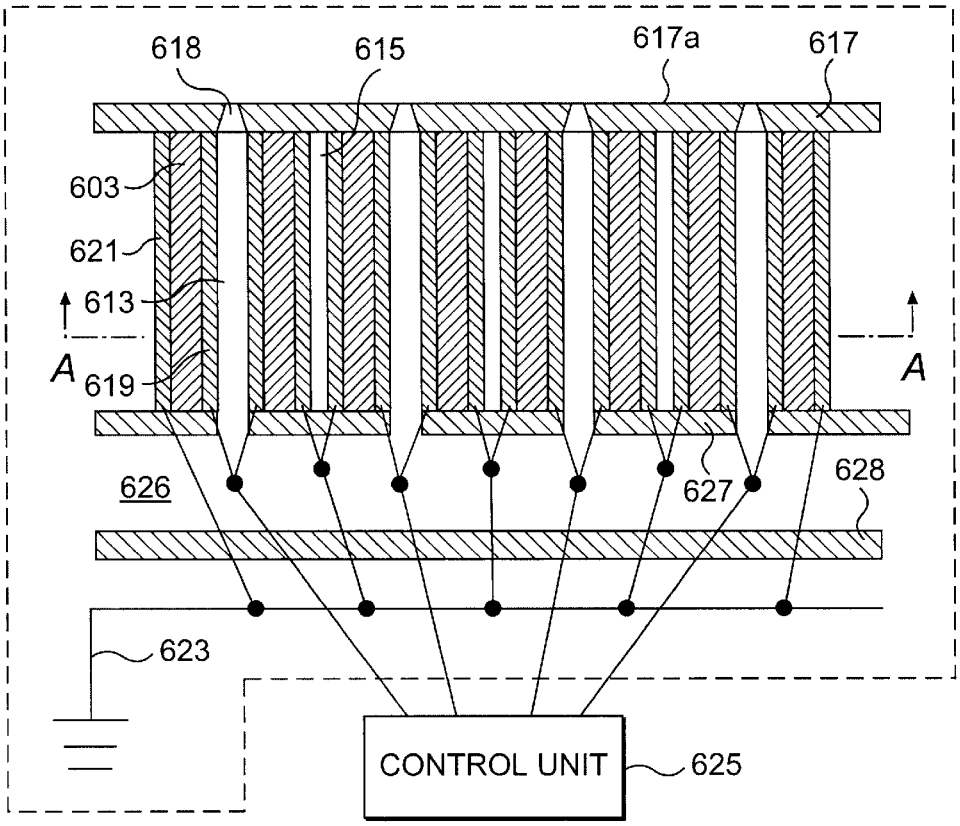
FIG. 1 (b) PRIOR ART

An ink ejection device according to preferred embodiments of the present invention will be described while referring to the accompanying drawings. A description of the mechanical parts in the ink ejection device 600 of the present embodiment will be omitted, as the construction of these parts is the same as the conventional device shown in FIGS. 1(*a*) and 1(*b*).

First the dimensions of the ink ejection device 600 will be described. The length L of the ink channel 613 is 7.5 mm. The diameter of the nozzles 618 on the nozzle plate 617*a* side is 40 $\mu$m. The diameter thereof on the ink channel 613 side is 72 $\mu$m. The length of the nozzles 618 is 100 $\mu$m. The ink supplied for the experiment described below has a viscosity of approximately 2 mPa·s at 25° C. and a surface tension of 30 mN/m. The ratio L/a, where L is the length L, described above and a is the speed of sound in the ink of the ink channel 613, is 8 $\mu$sec. L/a equals the time T required for a pressure wave to propagate once across the length of the ink channel 613. The value a for the speed of sound is the value at room temperature (25° C.). The ink ejection device 600 is mounted on a carriage that moves along a platen (not shown), forming a gap of 1–2 mm between the nozzle plate 617*a* and the recording paper (not shown) on the platen.

Figure 3:
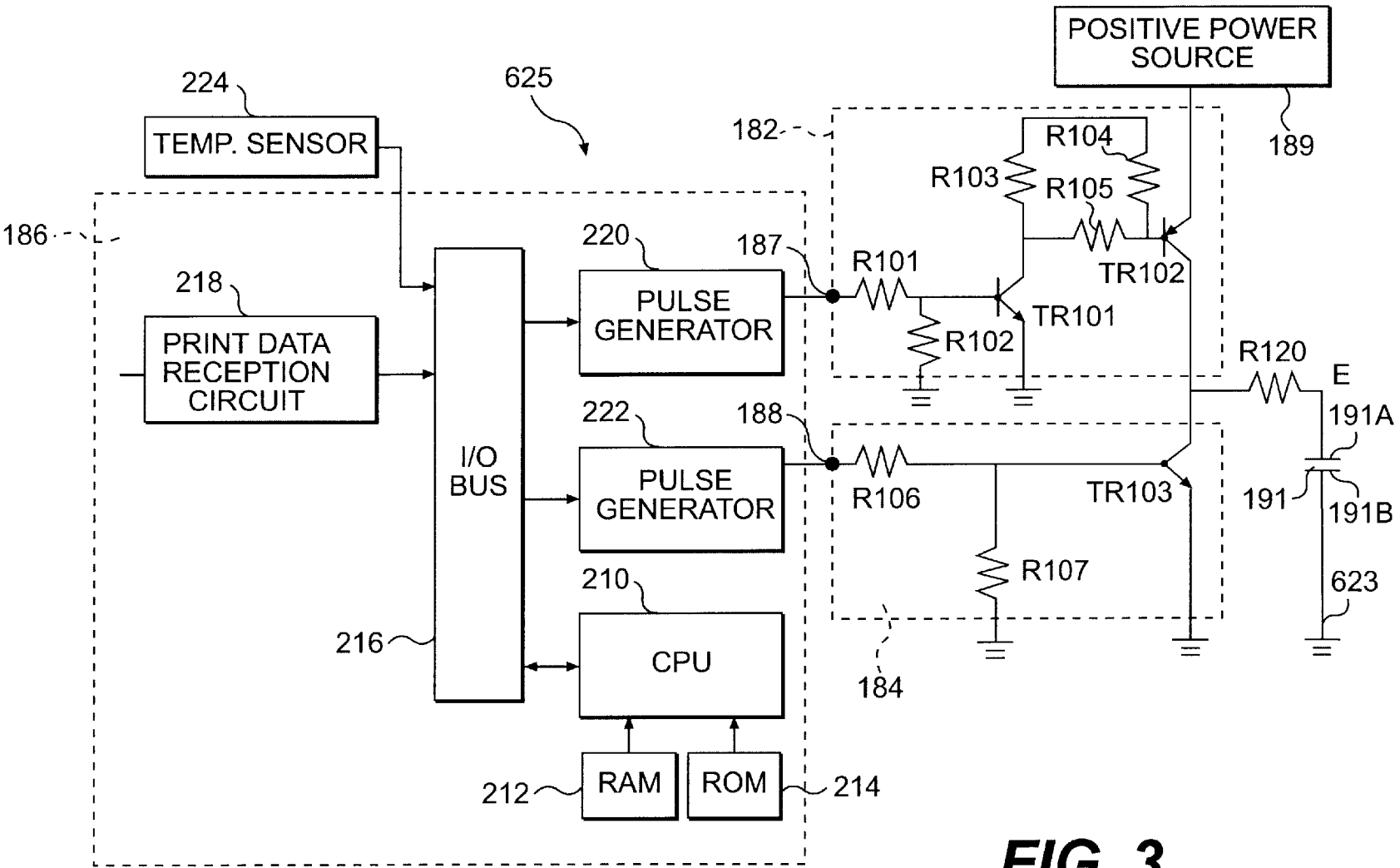
FIG. 3 is a circuit diagram for a control unit used in the ink ejection device according to the present invention.

FIG. 3 is a circuit diagram showing the construction of the control unit 625 used in the ink ejection device 600 of the present embodiment. As shown in FIG. 3, the control unit 625 includes a charge circuit 182, a discharge circuit 184, and a pulse control circuit 186. The piezoelectric materials and the electrodes 619 and 621 of the actuator wall 603 are represented by a capacitor 191, where a terminal 191A and a terminal 191B of the capacitor 191 correspond to the electrode 619 and electrode 621, respectively. In other words, the terminal 191A is connected to the control unit 625, while the terminal 191B is connected to ground 623.

An input terminal 187 provided on the charge circuit 182 and an input terminal 188 provided on the discharge circuit 184 receives pulse signals from the pulse control circuit 186 described later. In response to these pulse signals, a voltage of either E volts (for example, 20 volts) or 0 volts is applied to the electrode 619 (terminal 191A) in the ink channel 613.

The charge circuit 182 includes resistors R101, R102, R103, R104, and R105; and transistors TR101 and TR102. The base of the transistor TR101 is connected to the input terminal 187 via the resistor R101 and is grounded via the resistor R102. The emitter of the transistor TR101 is directly grounded, while the collector thereof is connected to a positive power source 189 via the resistor R103. The base of the transistor TR102 is connected to the positive power source 189 via the resistor R104 and is connected to the collector of the transistor TR101 via the resistor R105. The emitter of the transistor TR102 is connected directly to the positive power source 189, while the collector thereof is connected to the terminal 191A via a resistor R120.

With this construction, if an ON signal (+5 volts) is applied to the input terminal 187 of the charge circuit 182, the transistor TR101 is rendered conductive, and current from the positive power source 189 flows from the collector in the transistor TR101 toward the emitter. Accordingly, the voltage developed across the resistor R104 increases, causing an increase in the base current of the transistor TR102 and rendering the transistor TR102 conductive. Then, a voltage E volts from the positive power source 189 is applied to the terminal 191A via the emitter/collector junction of the transistor TR102 and the resistor R120.

Next, the construction of the discharge circuit 184 will be described. The discharge circuit 184 includes a resistor R106, resistor R107, and a transistor TR103. The base of the transistor TR103 is connected to the input terminal 188 via the resistor R106 and is grounded via the resistor R107. The emitter of the transistor TR103 is directly grounded, while the collector thereof is connected to the terminal 191A via the resistor R120 described above. With this construction, when an ON signal (+5 volts) is applied to the input terminal 188 of the discharge circuit 184, the transistor TR103 is rendered conductive, thereby grounding the terminal 191A via the resistor R120.

Next, variations of the voltages applied to the actuator wall 603, i.e., capacitor 191, according to the charge circuit 182 and discharge circuit 184 will be described.

An input signal applied to the input terminal 187 of the charge circuit 182 is shown in FIG. 4(*a*). Ordinarily, the signal is OFF. However, when ejecting ink, the signal is turned ON at a specified timing T1 and turned OFF at a specified timing T2, described later. The signal is subsequently turned ON again at a timing T3 and turned OFF at a timing T4. Once again, the signal is turned ON at a specified timing T5 and turned OFF at a timing T6. An input signal applied to the input terminal 188 of the discharge circuit 184 is shown in FIG. 4(*b*). This signal is turned OFF when the signal applied to the input terminal 187 is turned ON, that is, at T1, T3, and T5. The signal is turned ON when the signal applied to the input terminal 187 is turned OFF, that is, at T2, T4, and T6.

FIG. 4(*c*) shows the voltage appearing at the terminal 191A during this time. Normally, the voltage is maintained at 0 volts. Charging of the capacitor 191, that is, the actuator wall 603, starts at the timing T1. The voltage across the capacitor 191 reaches E volts after a charge time Ta determined by the transistor TR102, the resistor R120, and the electrostatic capacitance of the actuator wall 603 made from a shear mode type piezoelectric material. At the timing T2, discharging of the capacitor 191 begins, and the voltage drops to 0 volts after a discharge time Tb determined by the transistor TR103, the resistor R120, and the electrostatic capacitance of the actuator wall 603.

The voltage E volts appears at the electrode 619 after the time delay Ta from the application of the ON signal to the input terminal 187 of the charge circuit 182. Also, 0 volts appears at the electrode 619 after the time delay Tb from the stoppage of the application of the ON signal. Due to the delays Ta and Tb in the rising and falling edges in the voltage (hereinafter referred to as the "drive signal") appearing at the electrode 619, the points at which the voltage is a half of E volts (for example, 10 volts) is represented by rising timings AS, BS, and HS, and at falling timings AE, BE, and HE. The pulse control circuit 186 controls the timings T1–T6 of the signals applied to the input terminals 187 and 188 to achieve desirable rising and falling timings described later.

Next, the pulse control circuit 186 will be described with reference to FIG. 3. The pulse control circuit 186 is provided with a CPU 210 for performing various calculations; a RAM 212 for storing print and various other data; a ROM 214 for storing control programs for the pulse control circuit 186 and sequence data for generating ON and OFF signals at the timings T1–T6 described above; pulse generators 220 and 222 for generating pulses to be applied to the input terminals 187 and 188, respectively; a print data reception circuit 218 for receiving print commands from a host computer (not shown); and an I/O bus 216. The I/O bus 216 transfers data between a temperature sensor 224 for sensing a temperature of ink, print data reception circuit 218, pulse generators 220 and 222, and CPU 210.

As shown in FIG. 5, the ROM 214 includes an ink ejection device control program storage area 214A and a drive waveform data storage area 214B. The sequence data specifying the waveform of the drive signal is stored in the drive waveform data storage area 214B.

The CPU 210 controls the pulse generators 220 and 222 based on the sequence data stored in the drive waveform data storage area 214B. Therefore, by storing all the patterns of timings T1–T6 in the storage area 214B, a drive signal having a desired waveform can be applied to the actuator wall 603 in response to a 1-dot print command. The number of pulse generators 220 and 222, charge circuits 182, and discharge circuits 184 provided exactly equals the number of nozzles 618 in the ink ejection device 600. The CPU 210 outputs a drive signal to the actuator wall 603 in response to print data to eject ink from the corresponding nozzle 618. The temperature sensor 224 is a device well known in the art and functions to detect the temperature of ink in the ink channel 613.

Next, an example waveform of the drive signal (hereinafter referred to as "drive waveform") in an ink ejection device 600 according to the present embodiment will be described with reference to FIG. 6(*a*). Further, FIG. 6(*b*) illustrates pressure changes in the ink channel 613 in response to this drive waveform.

Figure 6:
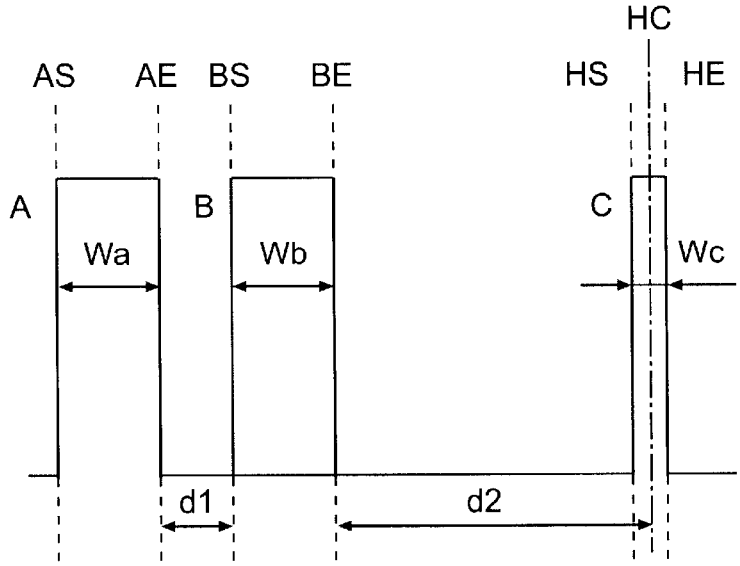
FIG. 6(*a*) is an explanatory diagram showing an example drive waveform output from the control unit of the ink ejection device.
Figure 6:
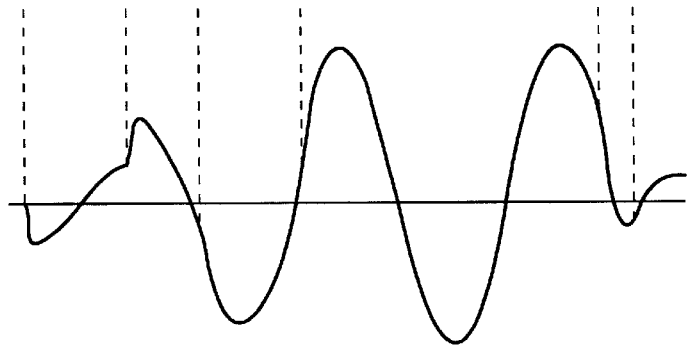

As shown in FIG. 6(*a*), the drive waveform of the present example includes two ejection pulse signals A and B for ejecting ink and one non-ejection pulse signal C for canceling the residual pressure wave vibrations in the ink channel 613. All of the pulse signals A, B, and C have a wave height (voltage) of E volts. Further, the pulse signals A, B, and C have respective pulse widths Wa, Wb, and Wc, which are set at 1.0 times, 1.0 times, and 0.5 times the time T (8 $\mu$sec) required for a pressure wave to propagate once across the length of the ink channel 613. The pulse interval d1 between the ejection pulse signals A and B is set at 0.75 T.

Figure 2:
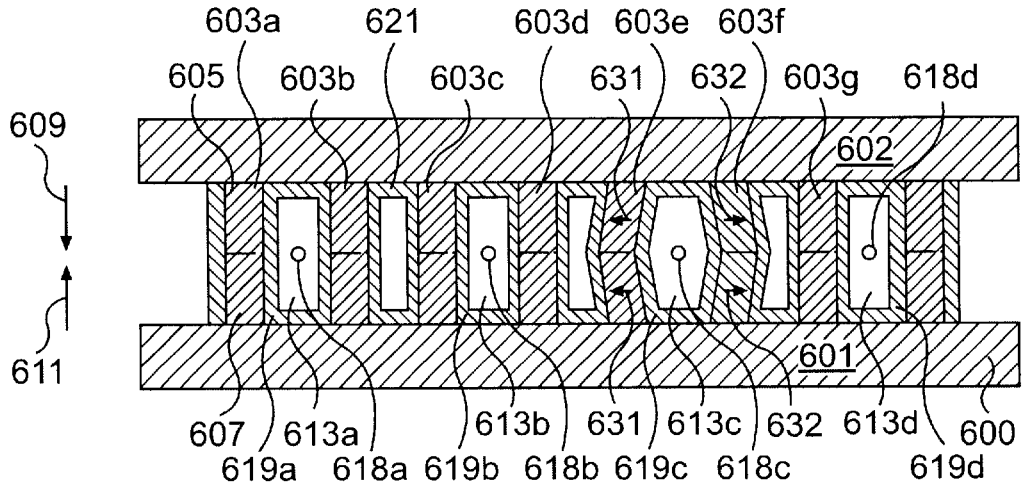
FIG. 2 PRIOR ART
FIG. 2 is an explanatory diagram showing an example operation executed by the ink ejection device of FIGS. 1(*a*) and 1(*b*)

As described in the example of ink channel 613*c* of FIG. 2, when the ejection pulse signal A rises at the timing AS, an electric field is developed in the actuator wall 603, causing the volume of the ink channel 613 to increase and the internal pressure of the same to decrease, including the area near the nozzle 618. At this time, ink flows into the ink channel 613, and pressure wave vibrations generated by the increased volume increase the internal pressure to a positive pressure, reaching a peak approximately after an interval of time T has elapsed. The ejection pulse signal A drops at the timing AE 1.0 T after the timing AS. At this time, the volume of the ink channel 613 decreases. The pressure generated by this decrease in volume adds to the positive pressure described above to generate a relatively high pressure near the nozzle 618, causing ink to eject from the same.

The ejection pulse signal B rises at the timing BS 0.75 T after the timing AE. At the timing BE, an additional 1.0 T after the timing BS, a second droplet of ink is ejected from the nozzle 618 in the same manner as described above. Subsequently, the non-ejection pulse signal C is generated after the pulse interval d2. The center HC of this pulse signal C should be set to the point in time that the internal pressure of the ink channel 613 switches from positive to negative.

The pressure wave vibrations in the ink can be canceled in the following way. If the non-ejection pulse signal C rises at the timing HS before the internal pressure of the ink channel 613 switches from positive to negative, the still positive pressure can be quickly decreased. Further, if the non-ejection pulse signal C drops at the timing HE after the pressure has become negative, the negative pressure can be quickly increased. Accordingly, the pressure wave vibrations can be canceled, allowing the vibrations to quickly converge. As a result, it is possible to prevent unintentional ink ejection and to quickly proceed to processing the next print command. Therefore, an ink ejection device of the present invention not only can form very good images, but also can improve printing speed. The non-ejection pulse signal C functions to cancel pressure wave vibrations, as described above, and moreover, will not cause ink to eject, since the pulse width Wc is considerably different from an odd multiple of the time T.

However, the speed of sound within the ink of the ink channel 613 varies according to the temperature of the ink. Accordingly, the actual value L/a of the time T also varies. Further, the period of the pressure wave vibrations in the ink, shown in FIG. 6(*b*), and an appropriate value of the pulse interval d2 change according to the temperature of the ink. Therefore, the pulse interval d2 is set in the following way. The inventor of the present invention performed an ink ejection experiment to study appropriate values for the pulse interval d2 at various temperatures. The results of the experiment are shown in Table 1 below.

TABLE 1

| d2<br>Temp | 2.30 | 2.35 | 2.40 | 2.45 | 2.50 | 2.55 | 2.60 | 2.65 | 2.70 | 2.75 |
|---|---|---|---|---|---|---|---|---|---|---|
| 0 | Δ | ○ | ○ | ○ | Δ | X | X | X | X | X |
| 5 | X | Δ | ○ | ○ | ○ | Δ | X | X | X | X |
| 10 | X | Δ | ○ | ○ | ○ | Δ | X | X | X | X |
| 15 | X | X | Δ | ○ | ○ | ○ | Δ | X | X | X |
| 20 | X | X | Δ | ○ | ○ | ○ | Δ | X | X | X |
| 25 | X | X | X | Δ | ○ | ○ | ○ | Δ | X | X |
| 30 | X | X | X | Δ | ○ | ○ | ○ | Δ | X | X |
| 35 | X | X | X | X | Δ | ○ | ○ | ○ | Δ | X |
| 40 | X | X | X | X | Δ | ○ | ○ | ○ | Δ | X |
| 45 | X | X | X | X | X | Δ | ○ | ○ | ○ | Δ |
| 50 | X | X | X | X | X | Δ | ○ | ○ | ○ | Δ |

○ No deviation in trajectory/no scatter
Δ Deviation in trajectory
X spray/no discharge In Table 1, the pulse interval d2 is a ratio to the time T at 25° C., and all temperatures are degrees Celsius. As shown in Table 1, a suitable value for the pulse interval d2 to achieve a good ejection without deviation in trajectory or spray gradually increases as the temperature increases. If the value of the pulse interval d2 deviates from an appropriate value, the pressure wave vibrations in the ink channel 613 will remain until ink is ejected in response to the next command. Hence, the trajectory speed of the ink droplet ejected next will not be appropriate, and deviation in trajectory will occur, in which the droplet is not deposited in a desirable location on the recording paper. If the disparity in the pulse interval d2 becomes worse, the ejected ink may become spray, scattering on the recording paper. Further, the spray may be deposited on the nozzle plate 617*a*, blocking discharge of the ink.

Therefore, the ink ejection device of the present embodiment sets the pulse interval d2 based on the temperature of the ink, as shown in Table 2. The temperature of the ink is detected via the temperature sensor 224. Further, the timings T1–T6 described above are set according to this pulse interval d2. Accordingly, high quality printing can be achieved when the ink is at any temperature between 0 and 40° C., without the occurrences of deviation in trajectory and spray. In addition to being able to form very accurate images, the printing speed can be greatly improved by converging the pressure wave vibrations of the ink at an early stage.

TABLE 2

| Temperature (° C.) | d2 (×T) |
|---|---|
| 0 to 10 | 2.45 |
| 10 to 20 | 2.50 |
| 20 to 30 | 2.55 |
| 30 to 40 | 2.60 |

Next, another embodiment of the present invention will be described. In this embodiment, the drive waveform also includes two ejection pulse signals A and B for ejecting ink and one non-ejection pulse signal C for canceling the residual pressure wave vibrations in the ink channel 613 as in the previous embodiment. All of the pulse signals A, B, and C have a wave height (voltage) of E volts. Further, the pulse signals A, B, and C have respective pulse widths Wa, Wb, and Wc, which are set at 1.0 times, 0.75 times, and 0.5 times the time T (8 $\mu$sec) required for a pressure wave to propagate once across the length of the ink channel 613. The pulse interval d1 between the ejection pulse signals A and B is set at 0.85 T.

As described in the example of ink channel 613*c* of FIG. 2, when the ejection pulse signal A rises at the timing AS, an electric field is developed in the actuator wall 603, causing the volume of the ink channel 613 to increase and the internal pressure of the same to decrease, including the area near the nozzle 618. At this time, ink flows into the ink channel 613, and pressure wave vibrations generated by the increased volume increase the internal pressure to a positive pressure (that is higher than the pressure at the center of the vibration), reaching a peak approximately after an interval of time T has elapsed. The ejection pulse signal A drops at the timing AE 1.0 T after the timing AS. At this time, the volume of the ink channel 613 decreases. The pressure generated by this decrease in volume adds to the positive pressure described above to generate a relatively high pressure near the nozzle 618, causing ink to eject from the same.

The ejection pulse signal B rises at the timing BS 0.85 T after the timing AE. At the timing BE, an additional 0.75 T after the timing BS, a second droplet of ink is ejected from the nozzle 618 in the same manner as described above. Subsequently, the non-ejection pulse signal C is generated after the pulse interval d2. This pulse signal C should be set to overlap the point in time that the internal pressure of the ink channel 613 switches from positive to negative.

The inventor of the present invention investigated different settings for the pulse interval d2 and discovered that the center HC of the non-ejection pulse signal C should be set to the point in time after the pressure wave vibrations cross the center of the vibration the third time after completion of the ejection operation according to ejection pulse signals A and B. In this case, the pressure wave vibrations in the ink channel 613 converge at an extremely early time, thereby efficiently preventing unintentional ink ejection and allowing the ink ejection device to proceed quickly to process the next print command. Moreover, the cancel operation can be reliably accomplished regardless of various other conditions.

Therefore, in the ink ejection device 600 of the present invention, the pulse interval d2 is set based on a calculated point in time. This point in time is the point when the pressure wave vibrations generated by outputting ejection pulse signals A and B crosses the center of the vibration the third time, changing from positive to negative pressure.

Figure 7:
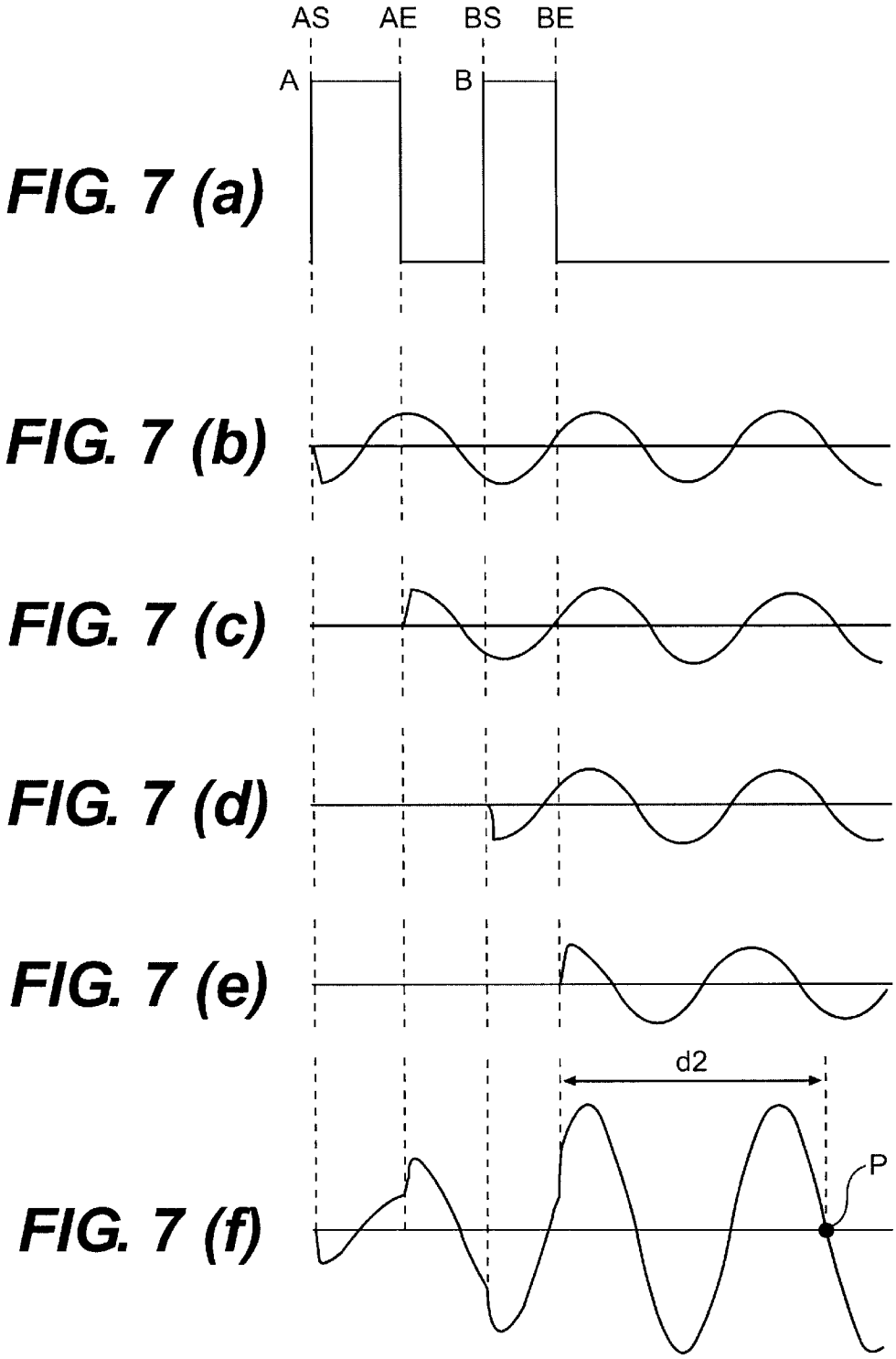
FIG. 7(*a*) is an explanatory diagram showing an example of a drive waveform output from the control unit of the ink ejection device.

Next, generation of the pressure wave vibrations will be described with reference to FIGS. 7(*a*) through 7(*f*). When an ejection pulse signal A rises at a timing AS, as shown in FIG. 7(*a*), pressure within the ink channel 613 drops suddenly, as shown in FIG. 7(*b*), and a sinusoidal pressure wave vibration having a period of about 2 T is subsequently generated. Hence, FIG. 7(*b*) shows the pressure wave vibration component within the ink channel 613 that is caused when the ejection pulse signal A rises.

Similarly, FIG. 7(*c*) shows the component of the pressure wave vibration caused when the ejection pulse signal A drops. Here, the pressure wave vibration rises suddenly when the ejection pulse signal A drops at a timing AE, and subsequently vibrates at a period of about 2 T. FIG. 7(*d*) shows the component of the pressure wave vibration caused when the ejection pulse signal B rises. Here, the pressure wave vibration drops suddenly when the ejection pulse signal B rises at a timing BS, and subsequently vibrates at a period of about 2 T. FIG. 7(*e*) shows the component of the pressure wave vibrations caused when the ejection pulse signal B drops. Here, the pressure wave vibration rises suddenly when the ejection pulse signal B drops at a timing BE, and subsequently vibrates at a period of about 2 T. The result of combining all components of the pressure wave vibrations is shown in FIG. 7(*f*). The pressure wave vibration in FIG. 7(*f*) is that which is actually generated in the ink channel 613 by the ejection pulse signals A and B.

Therefore, the inventor of the present invention calculated a point P signifying the point in time at which the pressure wave vibration of FIG. 7(*f*) crosses the center of the vibration the third time after the timing BE at which the ejection operation is completed. In other words, the point P denotes the point that the pressure wave vibration changes from positive to negative pressure the second time after completion of the ejection operation. In the present embodiment, the pulse interval d2 calculated based on the measured value for this point P is 2.51 T. By setting the pulse interval d2 to this value, it is possible to efficiently cancel the pressure wave vibrations, as described above.

The inventor of the present invention conducted an ink ejection experiment using the ink ejection device 600, in which experiment the pulse interval d2 and the pulse width Wc of the non-ejection pulse signal C were changed to various values in order to determine the allowable range of values for the pulse interval d2 and an appropriate value for the pulse width Wc. The results of this experiment are shown in Table 3 found at the end of the description. In Table 3, the deviation Δd2 from the calculated value 2.51 T of the pulse interval d2 and the pulse width Wc are written as ratios of the time T.

As indicated by Table 3, ejection is efficiently performed without generating spray or deviation in trajectory when the pulse interval d2 is set such that Δd2 is −0.3 to 0.3 T and when the pulse width Wc is set to 0.3 to 0.7 T or 1.3 to 1.7 T. If the value for d2 or Wc deviates slightly from an appropriate value, the pressure wave vibrations in the ink channel 613 will remain until ink is ejected in response to the next command. Hence, the trajectory speed of the ink droplet ejected next will not be appropriate, and deviation in trajectory will occur, in which case the droplet is not deposited in a desirable location on the recording medium. If the disparity in the pulse interval d2 or the pulse width Wc becomes worse, the ejected ink may become spray, scattering on the recording medium. Further, the spray may be deposited on the nozzle plate 617*a*, blocking discharge of the ink.

The results of the above experiment show that the value for the pulse interval d2 has an allowable error of about ±0.3. Also, the pulse width Wc should be set to 0.3 to 0.7 T or 1.3 to 1.7 T. The results for Wc are thought to be appropriate for the following reason. When Wc=1.0 T, the peak of the pressure wave vibrations generated by the increase in volume of the ink channel 613 (timing HS of FIG. 6(*a*)) and the increase of pressure caused by a decrease in the volume (timing HE of FIG. 6(*a*)) combine to eject ink from the nozzles. When Wc=2.0 T, the pressure wave vibrations caused by an increase in the volume of the ink channel and the pressure wave vibrations caused by a decrease in the volume cancel each other out, inviting the same effect as when a non-ejection pulse signal C is not generated. For this reason, it is thought that the cancel operation can be most effectively executed when the pulse width Wc is set between those values at 0.3 to 0.7 T or 1.3 to 1.7 T.

In the second embodiment described above, since the pulse interval d2 is set to 2.51 T and the pulse width Wc is set to 0.5 T, the pulse width vibrations can be very effectively canceled by the non-ejection pulse signal C. Further, the effects of this cancel operation demonstrate a high reliability. Accordingly, a very accurate image can be reliably formed without generating spray or deviation in trajectory, and the pressure wave vibrations are quickly converged, allowing the print speed to be effectively improved. Further, in the embodiment described above, the deviation Δd2 from the calculated value 2.51 T for the pulse interval d2 is set to 0, while the pulse width Wc is set between the shorter appropriate range 0.3 to 0.7 T. Accordingly, an accurate image can be even more reliably formed, and the print speed can be improved even more effectively.

While the invention has been described in detail with reference to specific embodiments thereof, it would be apparent to those skilled in the art that many modifications and variations may be made therein without departing from the spirit of the invention, the scope of which is defined by the attached claims. For example, the value of the pulse interval d2 can be set to a value other than that shown in Table 2, providing the value falls within the range indicated by a circle in Table 1, while achieving the same effects.

Further, it is possible to change the values for the pulse widths Wa and Wb and the pulse interval d1. For example, Wa, Wb, and d1 can be modified according to the temperature of the ink to correspond to the actual value of the time T, thereby improving the quality of ink ejection. However, in this case, the value for pulse interval d2 must also be changed.

As described in the embodiments above, two droplets of ink are ejected in response to each one-dot print command, but it is possible to only eject one droplet instead. However, as described above, consecutive ejection of a plurality of ink droplets (three or more droplets is also possible) per each one-dot print command can form a richer and easier to see image on the recording paper.

Further, it is possible to set various times T for each prescribed temperature range and execute an operation to cancel the pressure wave vibrations based on those times T. However, the control process is easier when multiplying the time T by a standard coefficient for each prescribed temperature range, as described above.

Further, it is possible to prevent ink from being ejected when canceling the pressure wave vibrations by applying a voltage lower than E volts or a negative voltage as the non-ejection pulse signal C. However, since the ejection and canceling operations in the first embodiment described above are executed by setting the pulse signals A, B, and C to fixed values and adjusting the output timings AS-HE, only one power source is needed for outputting all of the pulse signals, greatly simplifying both construction and control of the device.

The present invention can be applied to devices for ejecting ink by quickly reducing the volume of the ink channel 613; to devices for applying pressure wave vibrations to ink via means other than actuators formed with a piezoelectric material; and to line printers having an ink ejection device 600 fixed to the body of the printing device. However, when using an actuator formed from piezoelectric elements as described above, the device can be made simpler to construct, more durable, and less expensive to produce.

As a modification to the second embodiment of the invention, the values for d2 and Wc can be set to any value within the range of values in Table 3 where the appropriate values are marked with circles. Although the reliability of the effects described above may degrade slightly if the values for d2 and Wc are varied, the same approximate effects can be obtained.

It is also possible to change the pulse widths Wa and Wb and the pulse interval d1 to other values. However, in this case, the value of the pulse interval d2 is also changed to an appropriate value. Further, it is also possible to provide a pressure sensing device in the ink channel 613 in order to detect pressure wave vibrations after completion of an ejection operation and calculate the point P of FIG. 7(*f*) and the pulse interval d2. In this case, ink having a different viscosity can be used according to the needs of the user, and the cancel operation can be effectively executed, even when changing the settings of Wa, Wb, and d1.

When repeatedly executing the ejection operation a plurality of times, the pressure wave vibrations in the ink channel 613 become complex. However, in the second embodiment described above, the timing for executing the canceling operation is set based on the time in which the pressure wave vibration crosses the center of the vibration, thereby simplifying setting of the device and reducing development costs.

The pressure wave vibrations when crossing the center of the vibration the third time is similar to those when crossing the center of the vibration an odd number of times other than three. Therefore, it is presumed that approximately the same effects can be obtained when executing the canceling operation based on this point in time, that is, when the pressure changes from positive to negative. To restate this idea, the pressure in the ink channel 613 has risen to approximately the peak immediately after the ejection operation, after which the pressure wave vibrates periodically. When the pressure wave vibration crosses the center of the vibration an odd number of times, the vibration crosses the center in a declining direction at approximately the same slope each time. If the cancel operation is executed when the pressure wave vibration crosses the center of the vibration on the fifth or seventh time, the processing time for one-dot of print data is longer. However, if the time T is sufficiently short, this method also has advantages. Further, in this case, it is possible to set the pulse width Wc to approximately 2.3 to 2.7 T.

TABLE 3

| Wc / d2 | 0.2 | 0.3 | 0.4 | 0.5 | 0.6 | 0.7 | 0.8 | 0.9 | 1.0 | 1.1 | 1.2 | 1.3 | 1.4 | 1.5 | 1.6 | 1.7 | 1.8 | 1.9 | 2.0 |
|---|---|---|---|---|---|---|---|---|---|---|---|---|---|---|---|---|---|---|---|
| −0.5 | X | X | X | X | X | X | X | X | X | X | X | X | X | X | X | X | X | X | X |
| −0.4 | Δ | Δ | Δ | Δ | Δ | Δ | Δ | X | X | X | Δ | Δ | Δ | Δ | Δ | Δ | Δ | Δ | X |
| −0.3 | Δ | ○ | ○ | ○ | ○ | ○ | Δ | X | X | X | Δ | ○ | ○ | ○ | ○ | ○ | ○ | Δ | X |
| −0.2 | Δ | ○ | ○ | ○ | ○ | ○ | Δ | X | X | X | Δ | ○ | ○ | ○ | ○ | ○ | ○ | Δ | X |
| −0.1 | Δ | ○ | ○ | ○ | ○ | ○ | Δ | X | X | X | Δ | ○ | ○ | ○ | ○ | ○ | ○ | Δ | X |
| 0.0 | Δ | ○ | ○ | ○ | ○ | ○ | Δ | X | X | X | Δ | ○ | ○ | ○ | ○ | ○ | ○ | Δ | X |
| 0.1 | Δ | ○ | ○ | ○ | ○ | ○ | Δ | X | X | X | Δ | ○ | ○ | ○ | ○ | ○ | ○ | Δ | X |
| 0.2 | Δ | ○ | ○ | ○ | ○ | Δ | X | X | X | X | Δ | ○ | ○ | ○ | ○ | ○ | ○ | Δ | X |
| 0.3 | Δ | ○ | ○ | ○ | ○ | ○ | Δ | X | X | X | Δ | ○ | ○ | ○ | ○ | ○ | ○ | Δ | X |
| 0.4 | Δ | Δ | Δ | Δ | Δ | Δ | Δ | X | X | X | Δ | Δ | Δ | Δ | Δ | Δ | Δ | Δ | X |
| 0.5 | X | X | X | X | X | X | X | X | X | X | X | X | X | X | X | X | X | X | X |

What is claimed is:

1. An ink ejection device, comprising:

a nozzle plate formed with nozzles from which ink is ejected;

walls including side walls, a ceiling wall and a bottom wall, said walls defining an ink channel having a volume filled with ink and having a length defined by two ends, said nozzle plate being attached to one of the two ends of the ink channel;

an actuator that applies pressure wave vibrations to the ink in the ink channel;

a temperature sensor that senses a temperature indicative of a temperature of the ink in the ink channel;

a control unit that executes an ejection operation by applying an ejection pulse to said actuator to apply pressure wave vibrations to the ink in the ink channel and cause ink to eject from the nozzle, and that executes an auxiliary operation by applying a non-ejection pulse to said actuator, ink being not ejected attendant to the auxiliary operation, intervals between the ejection pulse and the non-ejection pulse being stored and becoming selected as a function of a plurality of temperatures sensed by said temperature sensor.

2. The ink ejection device as claimed in claim 1, wherein said control unit executes the auxiliary operation after the ejection operation.

3. The ink ejection device as claimed in claim 2, wherein said actuator varies the volume of the ink channel, and after executing the ejection operation, said control unit drives said actuator to increase and decrease the volume of the ink channel at the timings determined based on the temperature of the ink in the ink channel.

4. The ink ejection device as claimed in claim 3, wherein said control unit drives said actuator to first increase the volume of the ink channel and to then decrease the volume of the ink channel to eject ink from the nozzle, and, following a time interval determined according to both a time required for the ink pressure wave vibrations to propagate one way through the ink channel and the temperature of the ink, subsequently executes the canceling operation by again driving said actuator to first increase and then decrease the volume of the ink channel.

5. The ink ejection device as claimed in claim 4, wherein said control unit executes the ejection operation in response to a one-dot print command commanding to print one dot on a recording medium and executes the canceling operation after a time interval d2, wherein d2 equals:

2.45 T, when the ink temperature in the ink channel is between 0 and 10° C.;

2.50 T, when the ink temperature in the ink channel is between 10 and 20° C.;

2.55 T, when the ink temperature in the ink channel is between 20 and 30° C.; and 2.60 T, when the ink temperature in the ink channel is between 30 and 40° C.;

wherein T is the time required for the ink pressure wave vibrations to propagate one way through the ink channel at room temperature.

6. The ink ejection device as claimed in claim 5, wherein said control unit executes a first phase of the ejection operation by driving said actuator to first increase the volume of the ink channel and, following a time interval of 1.0 T or an odd multiple thereof, to then decrease the volume of the ink channel to eject a first ink droplet from the nozzle;

and, following a time interval of 0.75 T, said control unit subsequently executes a second phase of the ejection operation by again driving said actuator to first increase the volume of the ink channel and, following a time interval of 1.0 T or an odd multiple thereof, to decrease the volume of the ink channel to eject a second ink droplet from the nozzle, the first ink droplet and the second ink droplet forming one dot on the recording medium.

7. The ink ejection device as claimed in claim 2, wherein the auxiliary operation is a canceling operation for eliminating the pressure wave vibrations in the ink which remain after execution of the ejection operation.

8. The ink ejection device as claimed in claim 1, wherein said control unit increases or decreases the volume of the ink channel by applying a voltage to said actuator, and, also applies the voltage to said actuator both during the ejection operation and during the canceling operation.

9. The ink ejection device as claimed in claim 1, wherein said actuator is formed of a piezoelectric material and provided as said side walls of the ink channel.

10. The ink ejection device as claimed in claim 1, further comprising a memory that stores a plurality of values regarding an interval between the ejection pulse and the non-ejection pulse, the plurality of values being determined depending on temperature ranges, and wherein one value is selected, as the interval between the ejection pulse and the non-ejection pulse, from the plurality of values as the temperature sensed by said temperature sensor falls into a corresponding temperature range, whereupon the ejection operation is executed.

11. An ink ejection-device, comprising:

a nozzle plate formed with nozzles from which ink is ejected;

walls including side walls, a ceiling wall and a bottom wall, said walls defining an ink channel having a volume filled with ink and having a length defined by two ends, said nozzle plate being attached to one of the two ends of the ink channel;

an actuator that varies the volume of the ink channel; and a control unit that executes an ejection operation by driving said actuator to generate pressure wave vibrations in the ink channel and cause ink to eject from the nozzle, and that subsequently executes a canceling operation by driving said actuator to first increase and then decrease the volume of the ink channel in order to eliminate the pressure wave vibrations in the ink, wherein the volume increases and decreases of the canceling operation are executed as a function of a plurality of temperatures and when the pressure wave vibrations cross a neutral pressure level an odd number of times.

12. The ink ejection device as claimed in claim 11, wherein the odd number of times is three.

13. The ink ejection device as claimed in claim 11, wherein said control unit repeatedly executes the ejection operation a plurality of times in response to a one-dot print command commanding to print one dot on a recording medium and executes the canceling operation after all ejection operations are completed for the one-dot print command.

14. The ink ejection device as claimed in claim 11, wherein a time that elapses during the canceling operation after the volume of the ink channel is increased until the volume is decreased is substantially 0.3 to 0.7 times a time required for a pressure wave to propagate once across the length of the ink channel.

15. The ink ejection device as claimed in claim 11, wherein a time that elapses during the canceling operation after the volume of the ink channel is increased until the volume is decreased is substantially 1.3 to 1.7 times a time required for a pressure wave to propagate once across the length of the ink channel.

16. The ink ejection device as claimed in claim 11, wherein said control unit increases or decreases the volume of the ink channel by applying a voltage to said actuator, and, also applies the voltage to said actuator both during the ejection operation and during the canceling operation.

17. The ink ejection device as claimed in claim 11, wherein said actuator is formed of a piezoelectric material and provided as said side walls of the ink channel.

18. A method for driving an ink ejection device having a nozzle plate formed with nozzles from which ink is ejected; walls including side walls, a ceiling wall and a bottom wall, said walls defining an ink channel having a volume filled with ink and having a length defined by two ends, said nozzle plate being attached to one of the two ends of the ink channel; an actuator that applies pressure wave vibrations to the ink in the ink channel; and a temperature sensor that senses a temperature indicative of a temperature of the ink in the ink channel, the method comprising the steps of:

executing an ejection operation by applying an ejection pulse to said actuator to apply pressure wave vibrations to the ink in the ink channel and cause ink to eject from the nozzle;

executing an auxiliary operation by applying a non-ejection pulse to said actuator, ink being not ejected attendant to the auxiliary operation, intervals between the ejection pulse and the non-ejection pulse being stored and becoming selected as a function of a plurality of temperatures sensed by said temperature sensor.

19. The method as claimed in claim 18, wherein the volume of the ink channel is increased or decreased by applying a voltage to said actuator, and, also the voltage is applied to said actuator both during the ejection operation and during the canceling operation.

20. The method as claimed in claim 18, wherein the auxiliary operation is executed after the ejection operation.

21. The method as claimed in claim 20, wherein after executing the ejection operation, said actuator increases and decreases the volume of the ink channel at the timings determined based on the temperature of the ink in the ink channel.

22. The method as claimed in claim 21, wherein said actuator first increases the volume of the ink channel and to then decreases the volume of the ink channel to eject ink from the nozzle, and, following a time interval determined according to both a time required for the ink pressure wave vibrations to propagate one way through the ink channel and the temperature of the ink, subsequently the canceling operation is executed by again driving said actuator to first increase and then decrease the volume of the ink channel.

23. The ink ejection device as claimed in claim 17, wherein the ejection operation is executed in response to a one-dot print command commanding to print one dot on a recording medium and the canceling operation is executed after a time interval d2, wherein d2 equals:

2.45 T, when the ink temperature in the ink channel is between 0 and 10° C.;

2.50 T, when the ink temperature in the ink channel is between 10 and 20° C.;

2.55 T, when the ink temperature in the ink channel is between 20 and 30° C.; and 2.60 T, when the ink temperature in the ink channel is between 30 and 40° C.; and wherein T is the time required for the ink pressure wave unit drives said actuator to increase and decrease the volume of the ink channel at the timings determined based on the temperature of the ink in the ink channel.

24. The method as claimed in claim 23, wherein a first phase of the ejection operation is executed by driving said actuator to first increase the volume of the ink channel and, following a time interval of 1.0 T or an odd multiple thereof, to then decrease the volume of the ink channel to eject a first ink droplet from the nozzle;

and, following a time interval of 0.75 T, a second phase of the ejection operation is subsequently executed by again driving said actuator to first increase the volume of the ink channel and, following a time interval of 1.0 T or an odd multiple thereof, to decrease the volume of the ink channel to eject a second ink droplet from the nozzle, the first ink droplet and the second ink droplet forming one dot on the recording medium.

25. The method as claimed in claim 20, wherein the auxiliary operation is a canceling operation for eliminating the pressure wave vibrations in the ink which remain after execution of the ejection operation.

26. The method as claimed in claim 18, further comprising the step of storing a plurality of values regarding an interval between the ejection pulse and the non-ejection pulse, the plurality of values being determined depending on temperature ranges, one value being selected, as the interval between the ejection pulse and the non-ejection pulse, from the plurality of-values as the temperature sensed by said temperature sensor falls into a corresponding temperature range, whereupon the ejection operation is executed.

27. A method for driving an ink ejection device having a nozzle plate formed with nozzles from which ink is ejected; walls including side walls, a ceiling wall and a bottom wall, said walls defining an ink channel having a volume filled with ink and having a length defined by two ends, said nozzle plate being attached to one of the two ends of the ink channel; and an actuator that varies the volume of the ink channel, the method comprising the steps of:

executing an ejection operation by driving said actuator to generate pressure wave vibrations in the ink channel and cause ink to eject from the nozzle; and subsequently executing a canceling operation by driving said actuator to first increase and then decrease the volume of the ink channel in order to eliminate the pressure wave vibrations in the ink, wherein the volume increases and decrease of the canceling operation are executed as a function of a plurality of temperatures and when the pressure wave vibrations cross a neutral pressure level an odd number of times.

28. The method as claimed in claim 27, wherein the odd number of times is three.

29. The method as claimed in claim 27, wherein the ejection operation is repeatedly executed a plurality of times in response to a one-dot print command commanding to print one dot on a recording medium and the canceling operation is executed after all ejection operations are completed for the one-dot print command.

30. The method as claimed in claim 27, wherein a time that elapses during the canceling operation after the volume of the ink channel is increased until the volume is decreased is substantially 0.3 to 0.7 times a time required for a pressure wave to propagate once across the length of the ink channel.

31. The method as claimed in claim 27, wherein a time that elapses during the canceling operation after the volume of the ink channel is increased until the volume is decreased is substantially 1.3 to 1.7 times a time required for a pressure wave to propagate once across the length of the ink channel.

32. The method as claimed in claim 27, wherein the volume of the ink channel is increased or decreased by applying a voltage to said actuator, and, also the voltage is applied to said actuator both during the ejection operation and during the canceling operation.

33. An ink ejection device, comprising:

a nozzle plate formed with nozzles from which ink is ejected;

an ink channel having a volume filled with ink, said ink channel supplying the ink to the nozzle;

an actuator that applies pressure wave vibrations to the ink in said ink channel;

a temperature sensor that senses a temperature of the ink in said ink channel;

a control unit that executes an ejection operation by driving said actuator in response to printing commands to apply pressure wave vibrations to the ink in said ink channel and cause ink to eject from the nozzle, and that subsequently executes a canceling operation by driving said actuator at timings determined based on the temperature of the ink in said ink channel in order to eliminate the pressure wave vibrations in the ink which remain after execution of the ejection operation.

34. The ink jet device as claimed in claim 33, wherein said control unit executes the auxiliary operation after the ejection operation.

35. The ink ejection device as claimed in claim 34, wherein said actuator varies the volume of said ink channel, and after executing the ejection operation, said control unit drives said actuator to increase and decrease the volume of said ink channel at the timings determined based on the temperature of the ink in said ink channel.

36. The ink ejection device as claimed in claim 35, wherein said control unit drives said actuator to first increase the volume of said ink channel and to then decrease the volume of said ink channel to eject ink from the nozzle, and, following a time interval determined according to both a time required for the ink pressure wave vibrations to propagate one way through said ink channel and the temperature of the ink, subsequently executes the canceling operation by again driving said actuator to first increase and then decrease the volume of said ink channel.

37. The ink ejection device as claimed in claim 36, wherein said control unit executes the ejection operation in response to a one-dot print command commanding to print one dot on a recording medium and executes the canceling operation after a time interval d2, wherein d2 equals:

2.45 T, when the ink temperature in said ink channel is between 0 and 10° C.;

2.50 T, when the ink temperature in said ink channel is between 10 and 20° C.;

2.55 T, when the ink temperature in said ink channel is between 20 and 30° C.; and 2.60 T, when the ink temperature in said ink channel is between 30 and 40° C.;

wherein T is the time required for the ink pressure wave vibrations to propagate one way through said ink channel at room temperature.

38. The ink ejection device as claimed in claim 37, wherein said control unit executes a first phase of the ejection operation by driving said actuator to first increase the volume of said ink channel and, following a time interval of 1.0 T or an odd multiple thereof, to then decrease the volume of said ink channel to eject a first droplet from the nozzle;

and, following a time interval of 0.75 T, said control unit subsequently executes a second phase of the ejection operation by again driving said actuator to first increase the volume of said ink channel and, following a time interval of 1.0 T or an odd multiple thereof, to decrease the volume of said ink channel to eject a second ink droplet from the nozzle, the first ink droplet and the second ink droplet forming one dot on the recording medium.

39. The ink ejection device as claimed in claim 34, wherein the auxiliary operation is a canceling operation for eliminating the pressure wave vibrations in the ink which remain after execution of the ejection operation.

40. The ink ejection device as claimed in claim 33, wherein said control unit increase or decreases the volume of said ink channel by applying a voltage to said actuator, and, also applies the voltage to said actuator both during the ejection operation and during the canceling operation.

41. The ink ejection device as claimed in claim 33, wherein said ink channel is defined by walls including side walls, a ceiling wall, and a bottom wall, and said actuator is formed of a piezoelectric material and provided as said walls of said ink channel.

42. The ink ejection device as claimed in claim 33, further comprising a memory that stores a plurality of values regarding an interval between the ejection pulse and the non-ejection pulse, the plurality of values being determined depending on temperature ranges, and wherein one value is selected, as the interval between the ejection pulse and the non-ejection pulse, from the plurality of values as the temperature sensed by said temperature sensor falls into a corresponding temperature range, whereupon the ejection operation is executed.

43. An ink ejection device, comprising:

a nozzle plate formed with nozzles from which ink is ejected;

an ink channel having a volume filled with ink, said ink channel supplying the ink to the nozzle;

an actuator that varies the volume of said ink channel; and a control unit that executes an ejection operation by driving said actuator to generate pressure wave vibrations in said ink channel and cause ink to eject from the nozzle, and that subsequently executes a canceling operation by driving said actuator to first increase and then decrease the volume of said ink channel in order to eliminate the pressure wave vibrations in the ink, wherein the volume increases and decreases of the canceling operation are executed as a function of a plurality of temperatures and when the pressure wave vibrations cross a neutral pressure level an odd number of times.

44. The ink ejection device as claimed in claim 43, wherein the odd number of times is three.

45. The ink ejection device as claimed in claim 43, wherein said control unit repeatedly executes the ejection operation a plurality of times in response to a one-dot print command commanding to print one dot on a recording medium and executes the canceling operation after all ejection operations are completed for the one-dot print command.

46. The ink ejection device as claimed in claim 43, wherein a time that elapses during the canceling operation after the volume of said ink channel is increased until the volume is decreased is substantially 0.3 to 0.7 times a time required for a pressure wave to propagate once across the length of said ink channel.

47. The ink ejection device as claimed in claim 43, wherein a time that elapses during the canceling operation after the volume of said ink channel is increased until the volume is decreased is substantially 1.3 to 1.7 times a time required for a pressure wave to propagate once across the length of said ink channel.

48. The ink ejection device as claimed in claim 43, wherein said control unit increases or decreases the volume of said ink channel by applying a voltage to said actuator, and, also applies the voltage to said actuator both during the ejection operation and during the canceling operation.

49. The ink ejection device as claimed in claim 43, wherein said ink channel is defined by walls including side walls, a ceiling wall, and a bottom wall, and said actuator is formed of a piezoelectric material and provided as said side walls of said ink channel.

50. A method for driving an ink ejection device having a nozzle plate formed with nozzles from which ink is ejected; an ink channel having a volume filled with ink, said ink channel supplying ink to the nozzle; an actuator that applies pressure wave vibrations to the ink in said ink channel; and a temperature sensor that senses a temperature indicative of a temperature of the ink in said ink channel, the method comprising the steps of:

executing an ejection by applying an ejection pulse to said actuator to apply pressure wave vibrations to the ink in said ink channel and cause ink to eject from the nozzle; and executing an auxiliary operation by applying a non-ejection pulse to said actuator, ink being not ejected attendant to the auxiliary operation, intervals between the ejection pulse and the non-ejection pulse being stored and becoming selected as a function of a plurality of temperatures sensed by said temperature sensor.

51. The method as claimed in claim 50, wherein the auxiliary operation is executed after the ejection operation.

52. The method as claimed in claim 51, wherein the auxiliary operation is a canceling operation for eliminating the pressure wave vibrations in the ink which remain after execution of the ejection operation.

53. The method as claimed in claim 51, wherein after executing the ejection operation, said actuator increases and decreases the volume of said ink channel at the timings determined based on the temperature of the ink in said ink channel.

54. The method as claimed in claim 53, wherein said actuator first increases the volume of said ink channel and to then decreases the volume of said ink channel to eject ink from the nozzle, and, following a time interval determined according to both a time required for the ink pressure wave vibrations to propagate one way through said ink channel and the temperature of the ink, subsequently the canceling operation is executed by again driving said actuator to first increase and then decrease the volume of said ink channel.

55. The ink ejection device as claimed in claim 54, wherein the ejection operation is executed in response to a one-dot print command commanding to print one dot on a recording medium and the canceling operation is executed after a time interval d2, wherein d2 equals:

2.45 T, when the ink temperature in said ink channel is between 0 and 10° C.;

2.50 T, when the ink temperature in said ink channel is between 10 and 20° C.;

2.55 T, when the ink temperature in said ink channel is between 20 and 30° C.; and 2.60 T, when the ink temperature in said ink channel is between 30 and 40° C.;

wherein T is the time required for the ink pressure wave vibrations to propagate one way through said ink channel at room temperature.

56. The method as claimed in claim 55, wherein a first phase of the ejection operation is executed by driving said actuator to first increase the volume of said ink channel and, following a time interval of 1.0 T or an odd multiple thereof, to then decrease the volume of said ink channel to eject a first ink droplet from the nozzle;

and, following a time interval of 0.75 T, a second phase of the ejection operation is subsequently executed by again driving said actuator to first increase the volume of said ink channel and, following a time interval of 1.0 T or an odd multiple thereof, to decrease the volume of said ink channel to eject a second ink droplet from the nozzle, the first ink droplet and the second ink droplet forming one dot on the recording medium.

57. The method as claimed in claim 50, wherein the volume of said ink channel is increased or decreased by applying a voltage to said actuator, and, also the voltage is applied to said actuator both during the ejection operation and during the canceling operation.

58. The method as claimed in claim 50, further comprising the steps of storing a plurality of values regarding an interval between the ejection pulse and the non-ejection pulse, the plurality of values being determined depending on temperature ranges, one value being selected, as the interval between the ejection pulse and the non-ejection pulse, from the plurality of values as the temperature sensed by said temperature sensor falls into a corresponding temperature range, whereupon the ejection operation is executed.

59. A method for driving an ink ejection device having a nozzle plate formed with nozzles from which ink is ejected; an ink channel having a volume filled with the ink, said ink channel supplying the ink to the nozzle; and an actuator that varies the volume of said ink channel, the method comprising the steps of:

executing an ejection operation by driving said actuator to generate pressure wave vibrations in said ink channel and cause ink to eject from the nozzle; and subsequently executing a canceling operation by driving said actuator to first increase and then decrease the volume of said ink channel in order to eliminate the pressure wave vibrations in the ink, wherein the volume increases and decreases of the canceling operation and executed as a function of a plurality of temperatures and when the pressure wave vibrations cross a neutral pressure level an odd number of times.

60. The method as claimed in claim 59, wherein the odd number of times is three.

61. The method as claimed in claim 59, wherein the ejection operation is repeatedly executed a plurality of times in response to a one-dot print command commanding to print one dot on a recording medium and the canceling operation is executed after all ejection operations are completed for the one-dot print command.

62. The method as claimed in claim 59, wherein a time that elapses during the canceling operation after the volume of said ink channel is increased until the volume is decreased is substantially 0.3 to 0.7 times a time required for a pressure wave to propagate once across the length of said ink channel.

63. The method as claimed in claim 59, wherein a time that elapses during the canceling operation after the volume of said ink channel is increased until the volume is decreased is substantially 1.3 to 1.7 times a time required for a pressure wave to propagate once across the length of said ink channel.

64. The method as claimed in claim 59, wherein the volume of said ink channel is increased or decreased by applying a voltage to said actuator, and, also the voltage is applied to said actuator both during the ejection operation and during the canceling operation.

* * * * *